US005186334A

United States Patent [19]

Fukudome et al.

[11] Patent Number: 5,186,334

[45] Date of Patent: Feb. 16, 1993

[54] BANK NOTE HANDLING APPARATUS OF A RECIRCULATING TYPE

[75] Inventors: Yoshio Fukudome, Ibaraki; Yasunori Hamada, Tsuchiura; Masao Okayama, Ryugasaki; Yutaka Kako, Nagoya; Tetsuo Saito; Itsunori Utsumi, both of Owariasahi, all of Japan

[73] Assignee: Hitachi, Ltd., Tokyo, Japan

[21] Appl. No.: 324,551

[22] Filed: Mar. 16, 1989

[30] Foreign Application Priority Data

Mar. 18, 1988 [JP] Japan ..... 63-63356

[51] Int. Cl.[5] ..... B07C 5/00

[52] U.S. Cl. ..... 209/534; 235/379; 902/12

[58] Field of Search ..... 209/534; 902/8, 12; 235/379

[56] References Cited

U.S. PATENT DOCUMENTS

| | | | |
|---|---|---|---|
| 4,465,925 | 8/1984 | Goi | 209/534 X |
| 4,479,049 | 10/1984 | Hirose | 209/534 X |
| 4,511,794 | 4/1985 | Imamichi | 209/534 X |
| 4,517,451 | 5/1985 | Kokubo et al. | 209/534 X |
| 4,524,268 | 6/1985 | Fukatsu | 235/379 |
| 4,549,661 | 10/1985 | Morishita et al. | 209/534 |
| 4,587,408 | 5/1986 | Watanabe | 209/534 X |
| 4,697,071 | 9/1987 | Hiraoka et al. | 209/534 X |
| 4,726,474 | 2/1988 | Arikawa et al. | 235/379 X |
| 4,733,765 | 3/1988 | Watanabe | 209/534 X |
| 4,744,468 | 5/1988 | Goi et al. | 209/534 |
| 4,775,783 | 10/1988 | Sasaki et al. | 235/379 |
| 4,866,254 | 9/1989 | Okayama et al. | 235/379 |

FOREIGN PATENT DOCUMENTS

| | | | |
|---|---|---|---|
| 109743 | 5/1984 | European Pat. Off. | 209/534 |
| 63664 | 5/1981 | Japan | 235/379 |
| 67694 | 3/1987 | Japan . | |
| 115593 | 5/1987 | Japan . | |
| 92566 | 4/1988 | Japan | 209/534 |
| 2159500 | 12/1985 | United Kingdom | 209/534 |

*Primary Examiner*—Johnny D. Cherry
*Assistant Examiner*—Andrew C. Pike
*Attorney, Agent, or Firm*—Antonelli, Terry, Stout & Kraus

[57] ABSTRACT

A bank note handling apparatus of a circulating type utilizes bank notes deposited by customers as payable bank notes. The following devices are provided in the form of a loop in a conveying passage downstream from a paying-in and paying-out device for use in depositing or withdrawing bank notes by customers: bank note stacking devices for stacking circulated bank notes; a first discriminating device for discriminating bank notes; a bank note receiving device for receiving bank notes that are not to be circulated; a second discriminating device for discriminating bank notes; a device for properly arranging the obverse and reverse sides of bank notes; and a temporary receiving device for temporarily receiving bank notes to be deposited or withdrawn. Hence, the conveying passages for the paying-in and paying-out device and the respective stacking devices are shortened, reducing the processing time.

8 Claims, 5 Drawing Sheets

BANK NOTE HANDLING APPARATUS OF A RECIRCULATING TYPE

BACKGROUND OF THE INVENTION

The present invention relates to a circulating-type bank note handling apparatus which utilizes bank notes that have been previously deposited by customers as payable bank notes, and more particularly to a bank note handling apparatus in which conveying routes for various units are formed in a linear configuration having few branch passages.

In a conventional automatic teller machine, an arrangement is adopted in which, as disclosed in Japanese Patent Unexamined Publication No. 62-115593, usable bank notes among those deposited by customers are circulated for use as payable bank notes to be dispensed. In an automatic teller machine having such a structure, the denomination and authenticity of a bank note and the extent of any damage to which it has been subjected are checked, together with discrimination of its obverse and reverse sides and so on, by a single discriminating unit provided in a conveying passage. This checking and discrimination procedure is conducted at the time of depositing, return of deposited money, withdrawal, loading of bank notes, collection of bank notes, and similar transactions.

As a modification of this type of automatic teller machine, the machine disclosed in Japanese Patent Unexamined Publication No. 62-67694 is arranged such that two discriminating units are respectively provided in a first position and a second position, and, in the former, the geometric nature of bank notes is the main item checked to allow those bank notes which cannot be identified to be discharged in advance, and information related to the authenticity, the denomination, etc., of bank notes is checked in the latter unit.

In such conventional systems, the arrangement is such that respective units such as the paying-in and paying-out means and the bank note stacking means are connected to each other by means of conveying passages with one or two discriminating units being used. Since the conveying passages tend to be long and have many curved portions, the efficiency of the assembled units is poor, and since there is substantially no linearity in the conveying passages, it has been difficult to remove bank notes when any trouble occurs.

SUMMARY OF THE INVENTION

Accordingly, an object of the present invention is to provide a bank note handling apparatus in which conveying passages are simplified by linearly combining respective units.

To this end, in accordance with the present invention there is provided a bank note handling apparatus comprising: paying-in and paying-out means having a separating mechanism and an accommodating mechanism; bank note conveying means in the form of a loop extending from the separating mechanism of the paying-in and paying-out means to the receiving mechanism thereof through a plurality of bank note stacking means, wherein a plurality of the bank note stacking means and a plurality of the discriminating means are arranged in series in the bank note conveying means.

Since the paying-in and paying-out means, the plurality of bank note stacking means, and the plurality of discriminating means are connected to each other by the conveying means in the form of a loop, the conveying passages connecting the paying-in and paying-out means and the respective stacking means are shortened, thereby allowing the processing time to be reduced.

In addition, since the conveying passage is formed linearly, it is possible to improve the processing efficiency when trouble occurs and enhance the efficiency of the assembled units, and the overall dimensions of the apparatus can be made more compact.

DESCRIPTION OF THE PREFERRED EMBODIMENT

Referring now to the accompanying drawings, a description will be given of the preferred embodiment of the present invention.

Figure 1:
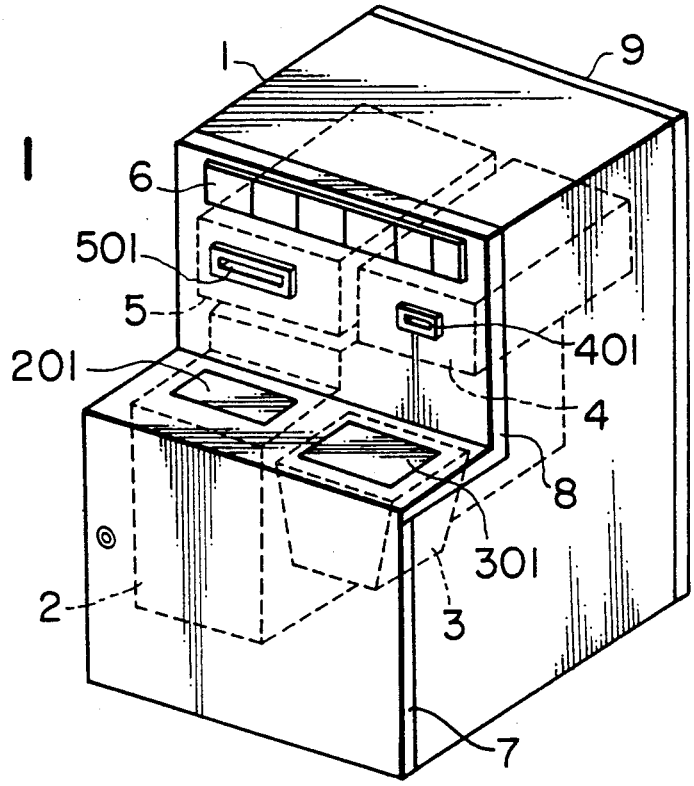
FIG. 1 is an overall perspective view of an embodiment of an automatic teller machine to which the apparatus of the present invention is applied.

FIG. 1 illustrates an external structure of one example of an automatic teller machine (hereafter referred to as the ATM) to which an embodiment of the present invention is applied. In this ATM, the following units are provided in a body of apparatus 1: a bank note handling mechanism unit 2 having a paying-in and paying-out port 201 and adapted to deal with depositing and withdrawal of bank notes; an operating unit 3 having an operation guide display 301 and operating buttons 302; a card and slip handling mechanism unit 4 having an inlet and outlet port 401 for cards and slips and adapted to handle cards and slips; a bank book handling mechanism unit 5 having an inlet and outlet port 501 for bank books and adapted to handle bank books; and a guide display unit 6 for displaying transaction business in which depositing, withdrawal, etc.; can be conducted. In addition, the body of apparatus 1 is provided with a front lower door 7, a front upper door 8, and a rear door 9 to facilitate maintenance and inspection of various mechanisms located therein so that they can be opened and closed by using special keys.

Figure 2:
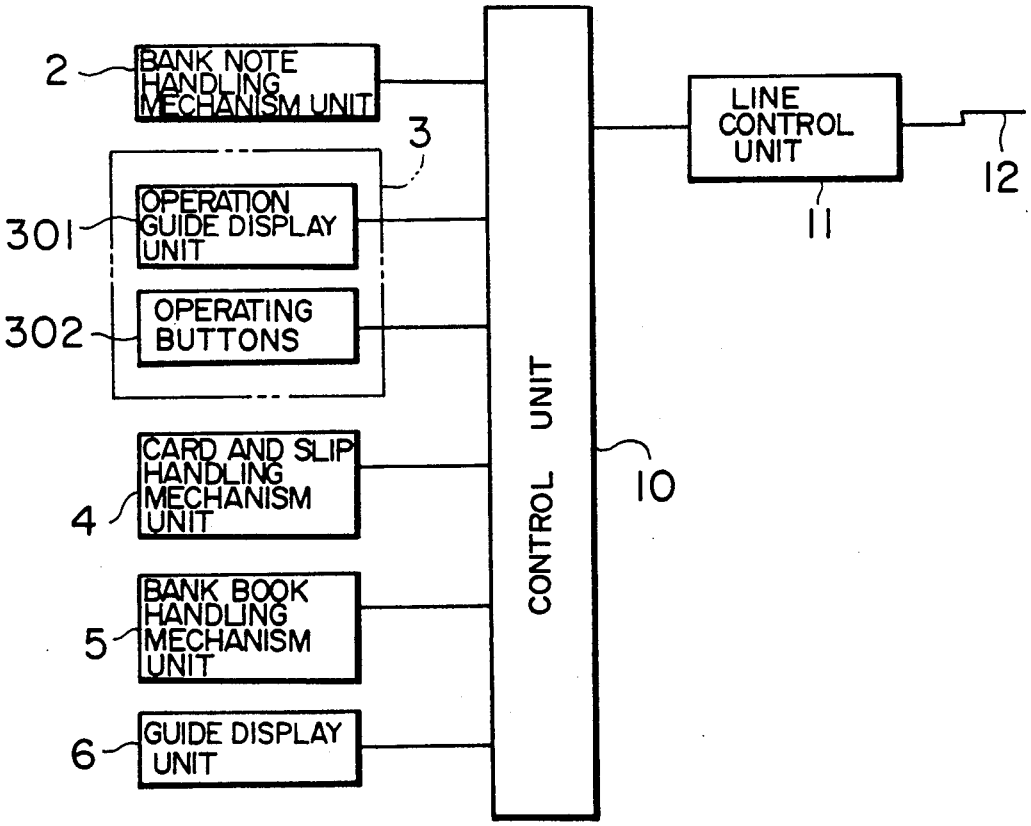
FIG. 2 is an internal structural block diagram of the apparatus shown in FIG. 1.

FIG. 2 illustrates an internal structure of the ATM shown in FIG. 1. The bank note handling mechanism unit 2, the operating unit 3 having the operation guide display 301 and the operating buttons 302, the card and slip handing mechanism unit 4, the bank book handling mechanism unit 5, and the guide display unit 6 are respectively connected to a control unit 10 of the ATM including a microprocessor. Various operations are controlled by this control unit 10 so as to carry out transactions.

Figure 3:
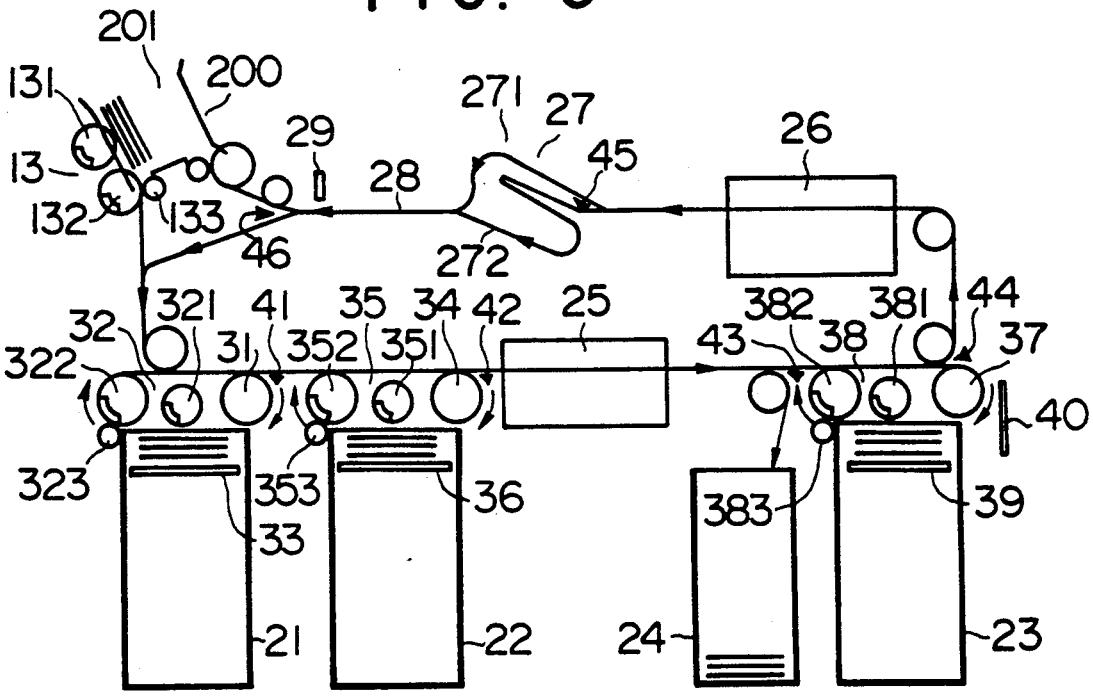
FIG. 3 is a diagram schematically illustrating an embodiment of a bank note handling mechanism unit in the present invention.

A line control unit 11 is connected to this control unit 10 to communicate with a central processor (not shown) via a communication line 12. FIG. 3 is a diagram schematically illustrating a structure of the bank note handling mechanism unit 2 shown in FIGS. 1 and 2.

The paying-in and paying-out port 201 of the paying-in and paying-out means 200 is provided on the front side of the body of the ATM, and is used for depositing and withdrawal of bank notes by customers.

This paying-in and paying-out means 200 is provided with a separating mechanism 13 adapted to separate one by one the bank notes deposited by the customer during depositing and to supply the same to a mechanism for temporarily storing bank notes, which will be described later.

The separating mechanism 13 is constituted by a separating means which includes the following components: pickup rollers 131 for supplying bank notes to the separating means side, feed rollers 132 located downstream of these pickup rollers 131 and adapted to separate one by one the bank notes fed by the pickup rollers 131 and supply the same to the latter stage-side mechanism for temporarily storing bank notes, and gate rollers 133.

A high-friction material such as elastic rubber is provided on a part of the outer peripheral surface of each of the pickup rollers 131, and the arrangement is such that the bank notes are supplied to the separating means side one by one each time the pickup roller undergoes, for instance, one rotation.

Figure 4:
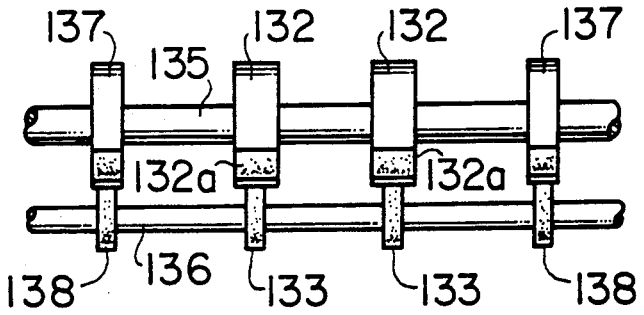
FIGS. 4 and 5 are diagrams illustrating schematically rollers of a separating unit shown in FIG. 3.
Figure 5:
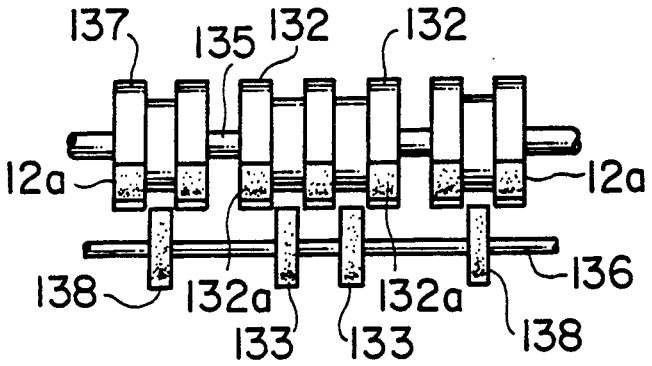

FIGS. 4 and 5 illustrate specific examples of the feed rollers 132 and the gate rollers 133.

A high-friction material 132*a* such as elastic rubber is provided on a part of the outer peripheral surface of each of the feed rollers 132, and the feed rollers 132 rotate in synchronism with the pickup rollers 131 in the same direction. The entire peripheries of the gate rollers 133 are formed of a high-friction material such as elastic rubber. The feed rollers 132 and the gate rollers 133 are respectively provided on an attaching shaft 135 and an attaching shaft 136 in such a manner as to abut against each other, as shown in FIG. 4. An arrangement may be alternatively provided such that the feed rollers 132 and the gate rollers 133 are respectively attached on the attaching shaft 135 and the attaching shaft 136 which are arranged parallel, in such a manner as to be axially offset from each other, and also each gate roller 133 is arranged between two of the feed rollers 132, 132 as shown in FIG. 5. In addition, the arrangement is such that the gate rollers 133 do not rotate in the advancing direction of bank notes (the bank note transit direction) during operation. However, since the gate rollers 133 are worn by the operation of separation and feeding of bank notes, the gate rollers 133 are rotated as required so that partial wear does not occur thereon.

In addition, stopper rollers 137 and gate rollers 138 are respectively provided on the feed roller attaching shaft 135 and the gate roller attaching shaft 136 in such a manner as to be located axially outside the positions where the feed rollers 132 and the gate rollers 133 are attached. The stopper rollers 137 and the gate rollers 138 are arranged in the same way as the feed rollers 132 and the gate rollers 133, and constitute a skew correcting section for correcting the skew of the bank notes in the separating means.

The following are provided along the downstream conveying passage of the paying-in and paying-out means 200 along the advancing direction of the bank notes: a first bank note stacking box 21; a second bank note stacking box 22; a first discriminating means 25; a bank note receiving box 24; a third bank note stacking box 23; a second discriminating means 26; means 27 for properly arranging the obverse and reverse sides of bank notes; and a mechanism 28 for temporarily receiving bank notes. This mechanism 28 for temporarily receiving bank notes is used to temporarily receive bank notes which have been conveyed, and is provided with a vertically movable stopper 29 in which the bank notes which could not be determined to be authentic during a depositing transaction are temporarily retained. During a withdrawing transaction, the stopper 29 retracts upward, and the bank notes being conveyed pass through the temporary receiving mechanism 28 and are received in the paying-in and paying-out port 201. The first bank note stacking box 21 has, as a bank note stacking mechanism unit, for instance, an impeller stacker 31, a bank note separating mechanism (bank note separating means) 32, and a vertically movable pressing plate 33. This separating mechanism 32 comprises pickup roller 321, feed roller 322, and gate roller 323. The second bank note stacking box 22 has, as a bank note stacking mechanism unit, for instance, an impeller stacker 34, a bank note separating mechanism 35 (bank note separating means), and a vertically movable pressing plate 36. This separating mechanism 35 comprises pickup roller 351, feed roller 352, and gate roller 353. The first discriminating means 25 has the function of discriminating the authenticity, the state of damage, and the denomination of the bank notes being conveyed. The bank note receiving box 24 receives bank notes that are not suited for circulation on the basis of the results of determination by the first discriminating means 25. The third bank note stacking box 23 has, as a bank note stacking mechanism unit, for instance, an impeller stacker 37, a bank note separating mechanism (bank note separating means) 38, a vertically movable pressing plate 39, and a partition plate 40 which is capable of supplying bank notes to, and withdrawing the same from, the third bank note stacking box 23. This separating mechanism 38 comprises pickup rollers 381, feed rollers 382, and gate rollers 383. The second discriminating means 26 has the function of discriminating the authenticity, the state of damage, the denomination, and the obverse or the reverse side of the bank notes being conveyed. The means 27 for properly arranging the obverse and reverse sides of bank notes is arranged such that, on the basis of the results of discrimination by the second discriminating means 26, the obverse bank notes pass along an obverse bank note conveying passage 271, while reverse bank notes, after being corrected to obverse bank notes when passing through a reverse bank note conveying passage 272, are conveyed to a converging point. Thus, the conveying passage in the form of a loop from the separating mechanism side of the paying-in and paying-out means 200 to the receiving mechanism side thereof constitutes a first conveying means, and the first conveying means includes a first bank note stacking box 21, a second bank note stacking box 22, a first discriminating means 25, a bank note receiving box 24, a third bank note stacking box 23, a second discriminating means 26, means 27 for properly arranging the observe and reverse sides of bank notes and a mechanism 28 for temporarily receiving bank notes. Also, the conveying passage which connects the stacking mechanism side of the paying-in and paying-out means 200 with the separating mechanism side thereof constitutes a second conveying means which diverges from the conveying passage on the stacking mechanism side of the paying-in and paying-out port and converges with the conveying passage on the separating mechanism side thereof.

Gates 41, 42, 43, 44, 45 and 46 for changing the advancing direction of bank notes are provided at diverging points in the above-described loop-shaped conveying passage.

The above-described bank note handling mechanism unit 2 effects such operations as the loading, paying-in, paying-out, and collection of bank notes, and the positions of gates 41 to 46, are changed during these operations on the basis of commands from the control unit 10.

Figure 6:
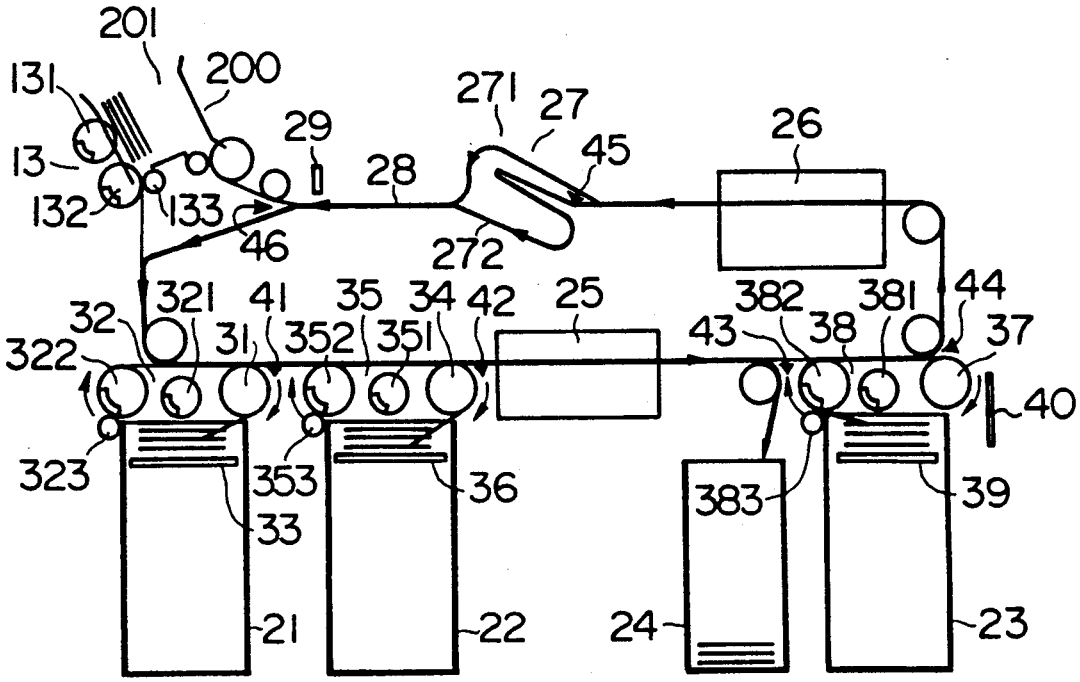
FIG. 6 is a diagram illustrating the operation of loading bank notes.
Figure 7:
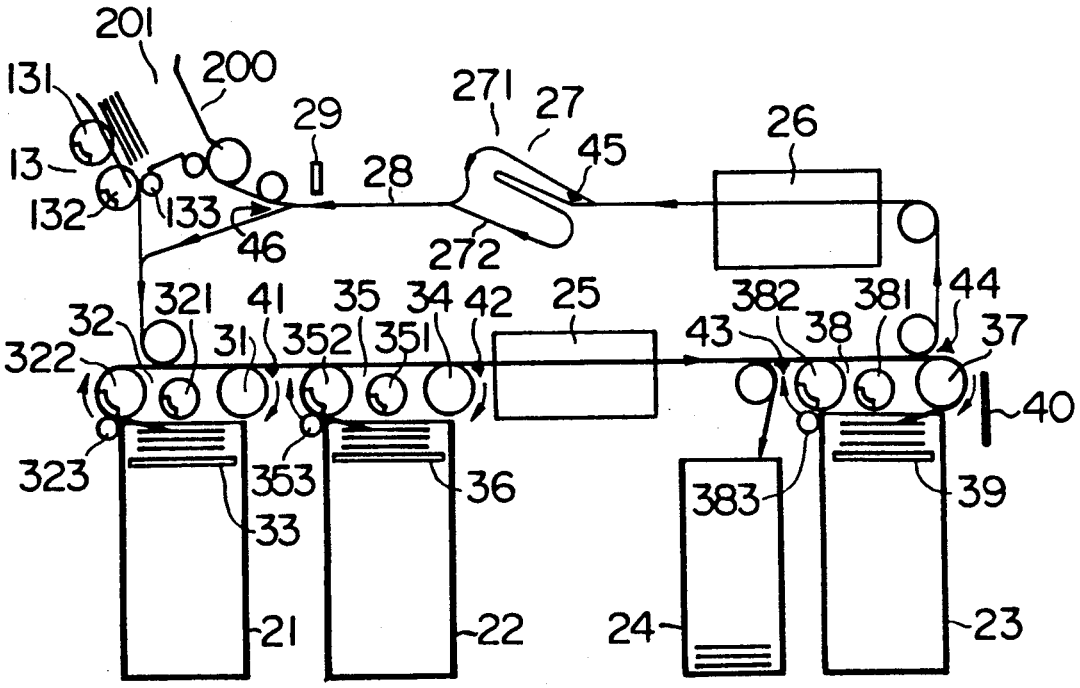
FIG. 7 is a diagram illustrating the operation of recovering bank notes.

A description will now be given of the respective operations in accordance with this embodiment. First, with reference to FIG. 6, a description will be given of the operation when the bank personnel loads bank notes in the ATM. During this operation, the positions of gates 41 to 46 have already been changed on the basis of commands from the control unit 10 in correspondence with the bank note loading operation, as described above. The flow of bank notes is indicated by the heavy line. A group of bank notes loaded by the personnel in the third bank note stacking box 23 is fed one by one to the conveying passage by the separating means 38 provided above the third bank note stacking box 23 and then passes through the second discriminating means 26. In this means, a check on the authenticity and the state of damage and discrimination of the denomination and the obverse and reverse sides of the bank notes are conducted. After the obverse and reverse sides of the bank notes have been arranged properly by the means 27, the bank notes are respectively conveyed in the direction of the first bank note stacking box 21, the second bank note stacking box 22, and the bank note receiving box 24. Thus, ten thousand yen notes are stacked in the first bank note stacking box 21, thousand yen notes are stacked in the second bank note stacking box 22, and damaged bank notes and those which could not be identified by the second discriminating means 26 are received in the bank note receiving box 24. When all the bank notes in the third bank note stacking box 23 are fed out and the stacking in the first and second bank note stacking boxes 21 and 22 is completed, a detailed check and the loading operation of the bank notes are completed. Referring now to FIG. 7, a description will be given of the operation in which the personnel collects bank notes stacked in the first bank note stacking box 21 and the second bank note stacking box 22.

During this operation, the positions of gates 41 to 46 have already been changed in correspondence with the operation of collecting bank notes on the basis of instructions from the control unit 10, as mentioned before. The flow of bank notes is indicated by the heavy line. The ten thousand yen notes in the first bank note stacking box 21 and the thousand yen notes in the second bank note stacking box 22 are fed one by one to the conveying passage by the separating means 32, 35 provided in the respective stacking boxes. Subsequently, on the basis of the results of discrimination by the first discriminating means 25, bank notes which could be discriminated are sent to the third bank note stacking box 23, while those bank notes that are not to be circulated, including those which could not be discriminated, are sent to the bank note receiving box 24. When the feeding out and receipt of all the bank notes are completed, a detailed check and the collecting operation are completed.

Figure 8:
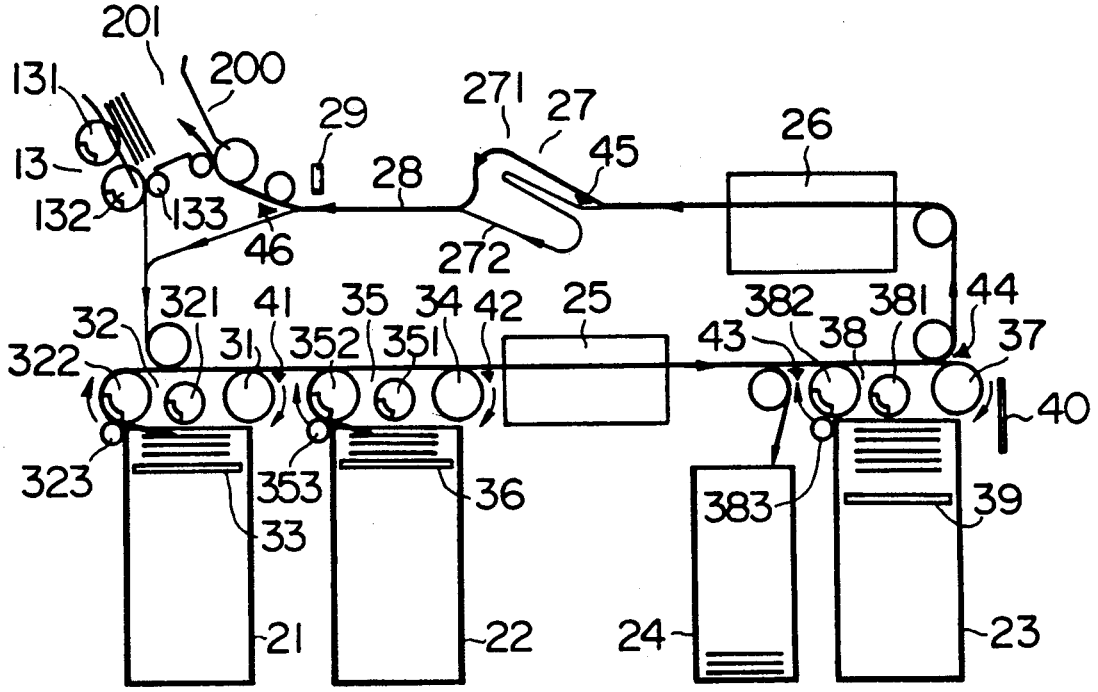
FIG. 8 is a diagram illustrating the operation of withdrawing bank notes.

Referring now to FIG. 8, a description will be given of the operation of withdrawing bank notes. During this operation as well, the positions of gates 41 to 46 have already been changed in correspondence with the operation of withdrawing bank notes, on the basis of instructions from the control unit 10. The flow of bank notes is indicated by the heavy line. In correspondence with the amount which the customer wishes to withdraw, ten thousand yen bank notes in the first bank note stacking box 21 and thousand yen bank notes in the second bank note stacking box 22 are fed one by one to the conveying passage by the separating means 32, 35 respectively provided in the stacking boxes. Subsequently the bank notes fed are discriminated by the first discriminating means 25, and those bank notes which could not be discriminated are received in the bank note receiving box 24 by the operation of the gate 43, while the other bank notes which were determined to be authentic ones are stacked in the paying-in and paying-out port 201. When the customer receives the bank notes, the paying-out operation is completed.

Figure 9:
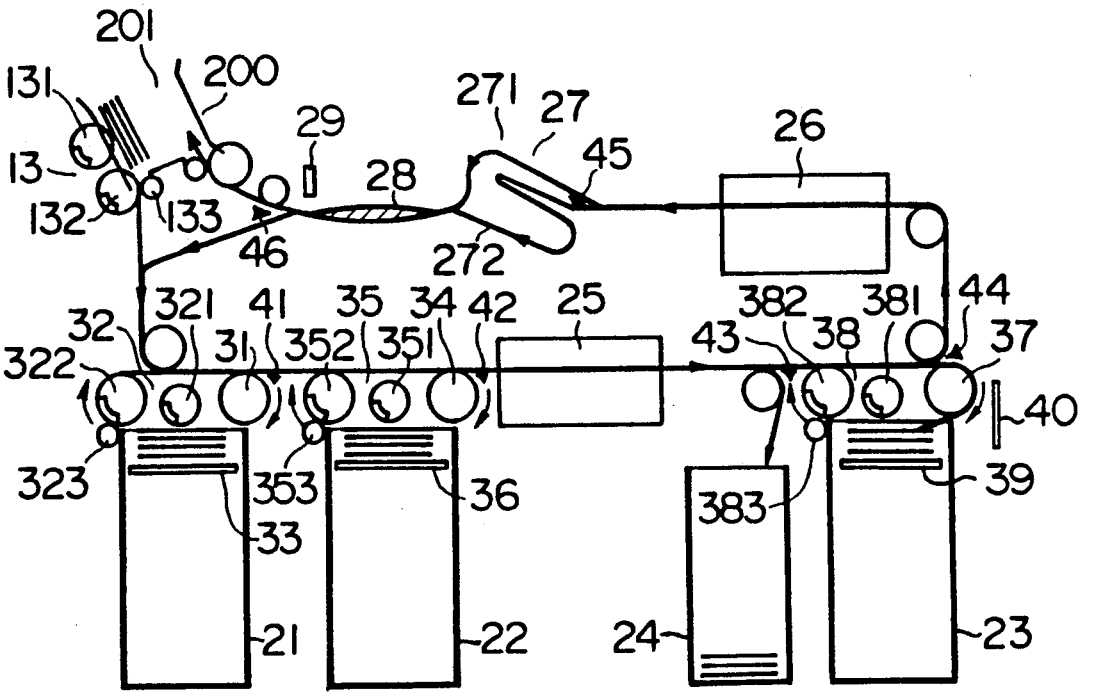
FIGS. 9, 10 and 11 illustrate the operation of depositing bank notes.
Figure 10:
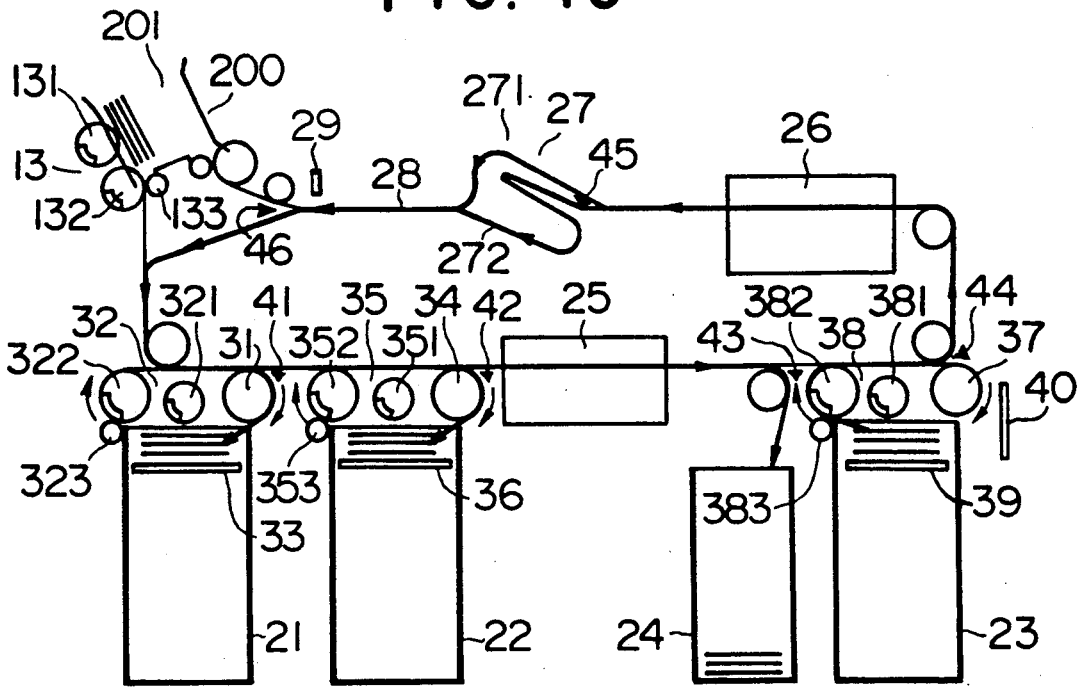
Figure 11:
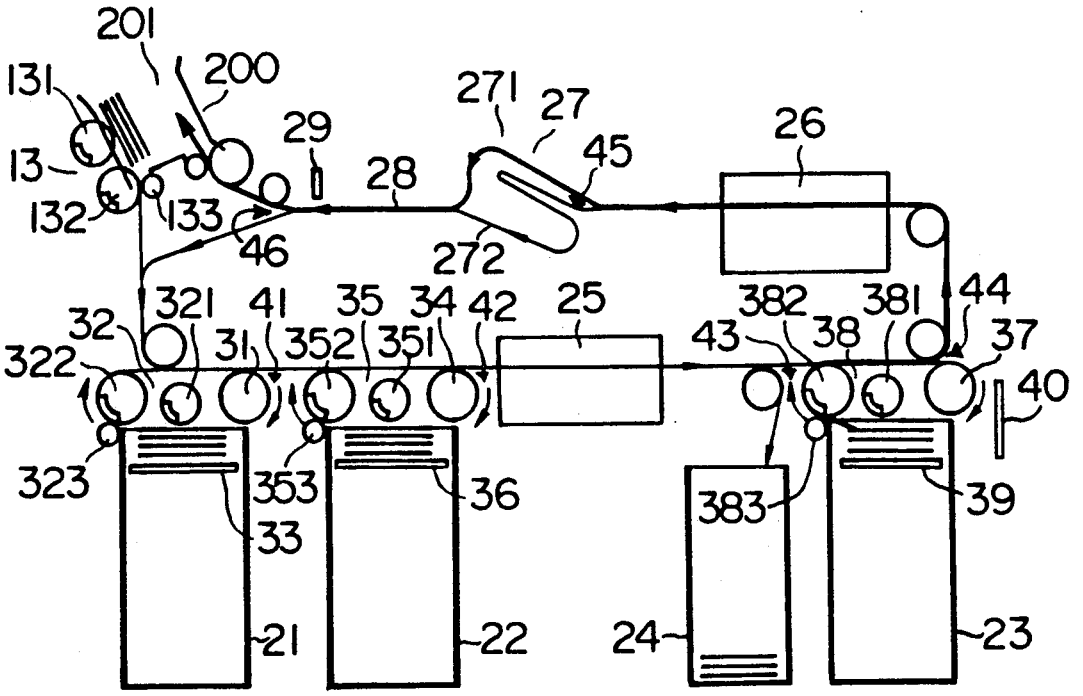

Referring now to FIGS. 9 to 11, a description will be given of the operation of depositing bank notes. During this operation, the positions of gates 41 to 46 have already been changed over in correspondence with the operation of depositing bank notes, on the basis of commands from the control unit 10. The flow of bank notes is indicated by the heavy line. The group of bank notes put into the paying-in and paying-out port by the customer are separated one by one by the separating mechanism 13 and are fed to the conveying passage, as shown in FIG. 9. The bank notes fed to the conveying passage are subjected to the discrimination of the authenticity and the denomination by the discriminating means 25, and the authentic notes are then stacked on the partition plate 40 of the third bank note stacking box 23 by the operation of the gate 44. Meanwhile, those notes which were determined to be counterfeit notes or those which could not be discriminated are stacked temporarily in the receiving mechanism 28 and, when there are no longer any bank notes at the paying-in and paying-out port 201, they are returned to the customer who is then requested to put them in again. During this depositing operation, when there are no bank notes to be received in the receiving mechanism 28, as the customer presses the paying-in confirmation button, the group of bank notes on the partition plate 40 of the third bank note stacking box 23 are fed one by one to the conveying passage by the separating means 38, as shown in FIG. 10, and are subjected to discrimination of the denomination, the state of damage, and the obverse or reverse side by the second discriminating means 26. On the basis of its results, the obverse notes are sent through the obverse note conveying passage 271 of the obverse and reverse side arranging means 27, while reverse notes are sent through the reverse note conveying passage 272 of the obverse and reverse side arranging means 27 by the operation of the gate 45. The bank notes thus properly arranged are fed to the conveying passage provided with the respective stacking boxes, by the operation of the gate 46. Then, the ten thousand yen notes are stacked in the first bank note stacking box 21 by the operation of the gate 41, the thousand yen notes are stacked in the second bank note stacking box 22 by the operation of the gate 42, while those which were determined to be damaged are received in the bank note receiving box 24 by the operation of the gate 43. In case where the customer wishes to stop depositing when a bank note which cannot be determined to be authentic is included among the bank notes to be deposited or in cases where the customer wishes to stop depositing even if all the bank notes are authentic, as the customer can press a transaction stopping button, the bank notes temporarily deposited in the receiving mechanism 28 and the third bank note stacking box 23 on the partition plate 40 are conveyed to and stacked at the paying-in and paying-out port 201, and the customer receives them, as shown in FIG. 11.

Thus, the arrangement of the units in accordance with the present invention is capable of satisfactorily performing all the necessary operations as a circulating type bank note handling mechanism.

What is claimed is:

1. A bank note handling apparatus for paying out bank notes and for stacking deposited bank notes, said apparatus comprising:

means for paying-in and paying-out bank notes having a separating mechanism and a receiving mechanism;

means for stacking a plurality of bank notes, said staking means having a separating mechanism and a stacking mechanism and being operative to store said deposited bank notes until said deposited bank notes are to be paid out, said bank notes being paid out starting with a most recently stacked bank note;

means for conveying bank notes, said conveying means being provided in a form of a closed loop conveyor extending from the separating mechanism of said means for paying-in and paying-out through said means for stacking a plurality of bank notes and to said receiving mechanism of said means for paying-in and paying-out with bank notes to be paid in and paid out being conveyed by said closed loop conveyor; and a plurality of means for discriminating a condition of bank notes being conveyed provided in said conveying means and spaced apart from on another along said closed loop conveyor.

2. A bank note handling apparatus for stacking deposited bank notes and circulating said deposited bank notes as payable ones starting with most recently deposited bank notes in response to a request, said apparatus comprising:

means for paying-in and paying-out bank notes having separating mechanism and a receiving mechanism;

a plurality of means for stacking bank notes each having a separating mechanism and a stacking mechanism;

means for receiving bank notes that are not to be circulated;

first means for conveying bank notes, said first means being provided in a form of a closed loop conveyor extending from said separating mechanism of said means for paying-in and paying-out to said receiving mechanism thereof;

first means for discriminating a condition of bank notes disposed in said first means for conveying;

second means for discriminating a condition of bank notes disposed in said first means for conveying, said second means for discriminating being spaced apart from said first means for discriminating, wherein said plurality of means for stacking bank notes are provided in said first means for conveying bank notes, and said means for receiving bank notes si disposed in said first means for conveying bank notes between said first means for discriminating and said second means for discriminating.

3. A bank note handling apparatus according to claim 2, wherein said first means for discriminating determines authenticity, a state of damage, and a type of denomination of said bank notes, while said second means for discriminating determines authenticity, a state of damage, a denomination, and at least one of an obverse and reverse side of the bank notes.

4. A bank note handling apparatus for stacking deposited bank notes and circulating said deposited bank notes a payable ones in response to a customer's request, said apparatus comprising:

means for paying-in and paying-out bank notes having a separating mechanism and a receiving mechanism;

means for conveying bank notes provided in a form of a closed loop conveyor between said separating mechanism and said receiving mechanism of said means for paying-in and paying-out;

a plurality of means for stacking bank notes each having a separating mechanism and a stacking mechanism and being operative to store said deposited bank notes until said deposited bank notes are to be pair out, wherein each of said plurality of means for stacking supplies bank notes to be paid out starting with a most recently deposited bank note;

means for receiving bank notes that are not to be circulated;

first means for discriminating a condition of said bank notes and second manes for discriminating a condition of said bank notes, said first and second discriminating means being disposed in said means for conveying bank notes and are spaced apart from one another along said closed loop conveyor and means for arranging obverse and reverse sides disposed in said means for conveying and adapted to properly arrange the obverse and reverse sides of the bank notes, wherein said plurality of means for stacking bank notes and said means for receiving bank notes are provided in said means for conveying bank notes between said separating mechanism and said receiving mechanism of said means for paying-in and paying-out.

5. A bank note handling apparatus for stacking deposited bank notes and circulating the deposited bank notes as payable one in response to a customer's request, said apparatus comprising:

means for paying-in and paying-out said deposited bank notes having a separating mechanism and a receiving mechanism;

a plurality of means for stacking bank notes each having a separating mechanism and a stacking mechanism and being operative to store said deposited bank notes until said deposited bank notes are to be paid out, wherein each of said plurality of means for stacking supplies bank notes to be paid out starting with a most recently deposited bank note;

means for receiving bank notes that are not to be circulated;

means for conveying bank notes provided in a form of a closed loop conveyor extending from said separating mechanism of said means for paying-in and paying-out through said plurality of means for stacking bank notes and said means for receiving bank notes to said receiving mechanism of said means for paying-in and paying-out;

a plurality of means for discriminating a condition of said bank notes, said plurality of means for discriminating being disposed apart from one another along the closed loop conveyor in said means for conveying bank notes; and a plurality of gate means for changing a direction of travel of said bank notes disposed along said means for conveying bank notes at least between each of said plurality of means for stacking bank notes, said gate means being operative to change over a conveying passage on the basis of a changeover signal.

6. A bank note handling apparatus for stacking deposited bank notes and circulating the deposited bank notes as payable ones in response to a customer's request, said apparatus comprising:

means for paying-in and paying-out bank notes having a separating mechanism and a receiving mechanism;

a plurality of means for stacking bank notes each having a separating mechanism and a stacking mechanism and being operative to store said deposited bank notes until said deposited bank noted are to be paid out, wherein each of said plurality of means for stacking supplies bank notes to be paid out starting with a most recently deposited bank note;

means for conveying bank notes extending from said separating mechanism of said means for paying-in and paying-out to said receiving mechanism of said means for paying-in and paying-out; and first means for discriminating a condition of said conveyed bank notes and second mean for discriminating a condition of said conveyed bank notes, wherein said first and second discriminating means are disposed apart from one another in said means for conveying bank notes, wherein said first means for discriminating operates at least during a collection operation and depositing operation of bank notes, and said second means for discriminating operates at least during a loading and a depositing operation of bank notes.

7. A bank note handling apparatus according to claim 6, wherein said first means for discriminating bank notes determines authenticity, a state of damage and a denomination of said conveyed bank notes, while said second means for discriminating bank notes determines authenticity, a state of damage, a denomination and at least one of an obverse and reverse side of said conveyed bank notes.

8. An automatic teller machine of a circulating type in which banknotes deposited by customers are used as payable ones, said automatic teller machine comprising:

a bank note handling apparatus for handling bank notes to be deposited and withdrawn;

an operating apparatus having a display unit for displaying an operating guide;

a card and slip handling apparatus for handling cards and slips; and a bank book handling apparatus for handling bank books;

wherein said bank note handling apparatus includes at least means for paying-in and paying-out bank notes having a separating mechanism and a receiving mechanism;

a plurality of means for stacking bank notes each having a separating mechanism and a stacking mechanism and being operative to store said deposited bank notes until said deposited bank notes are to be paid out, wherein each of said plurality of means for stacking supplies bank notes to be paid out starting with a most recently deposited bank note; means for receiving bank notes having a separating mechanism and a stacking mechanism; means for conveying bank notes provided in a form of a closed loop conveyor extending from the separating mechanism of said means for paying-in and paying-out to said receiving mechanism of said means for paying-in and paying-out, said means for conveying passing through said plurality of means for stacking bank notes and said means for receiving bank notes; and a plurality of means for discriminating a condition of said conveyed bank notes being provided a spaced distance apart from one another along the loop in said means for conveying bank notes.

* * * * *